US006701981B1

(12) United States Patent
Olsen

(10) Patent No.: US 6,701,981 B1
(45) Date of Patent: Mar. 9, 2004

(54) SYSTEM FOR LOADING AND UNLOADING FLUID PRODUCTS

(75) Inventor: Claes W. Olsen, His (NO)

(73) Assignee: Hitec Marine AS, Kolbjornsvik (NO)

( * ) Notice: Subject to any disclaimer, the term of this patent is extended or adjusted under 35 U.S.C. 154(b) by 0 days.

(21) Appl. No.: 10/009,237

(22) PCT Filed: Jun. 9, 2000

(86) PCT No.: PCT/NO00/00201

§ 371 (c)(1),
(2), (4) Date: May 13, 2002

(87) PCT Pub. No.: WO00/75008

PCT Pub. Date: Dec. 14, 2000

(30) Foreign Application Priority Data

Jun. 9, 1999 (NO) ..... 19992814

(51) Int. Cl.[7] ..... B63B 27/30

(52) U.S. Cl. ..... 141/388; 141/297; 137/615; 441/5; 114/230.12; 114/230.1; 114/293

(58) Field of Search ..... 114/230.1, 230.12, 114/230.13, 230.2, 230.21, 230.25, 293; 141/279, 387, 388; 137/615; 441/1–5

(56) References Cited

U.S. PATENT DOCUMENTS

| | | | | |
|---|---|---|---|---|
| 3,922,992 A | | 12/1975 | Wilbourn | |
| 4,547,163 A | | 10/1985 | Langpaap et al. | |
| 4,637,336 A | | 1/1987 | Engelskirchen | |
| 5,346,314 A | * | 9/1994 | Perratone et al. | 384/97 |
| 5,468,166 A | * | 11/1995 | Breivik et al. | 441/5 |
| 5,515,803 A | | 5/1996 | Korsgaard | |
| 5,676,083 A | * | 10/1997 | Korsgaard | 114/230.1 |
| 5,803,779 A | | 9/1998 | Horton, III | |

FOREIGN PATENT DOCUMENTS

| | | |
|---|---|---|
| GB | 1 238 543 | 6/1968 |
| GB | 2 179 903 | 2/1984 |
| GB | 2 191 462 | 6/1987 |
| GB | 2 239 441 | 11/1990 |

* cited by examiner

*Primary Examiner*—J. Casimer Jacyna
(74) *Attorney, Agent, or Firm*—Pitney, Hardin, Kipp & Szuch LLP

(57) ABSTRACT

System for loading and unloading of fluid products to or from a vessel (1), where a fluid hose (4) is fastened to the bottom side of a submerged frame (2) so that the frame (2) is free to turn around a vertical axis with respect to the hose (4) in that an additional hose (9) is connected with the hose (4) at the frame and with the vessels coupling for loading and unloading, and that the frame (2) may be maneuvered with contact against the bottom of the vessel, and held in positioned during the operation.

8 Claims, 1 Drawing Sheet

SYSTEM FOR LOADING AND UNLOADING FLUID PRODUCTS

BACKGROUND OF THE INVENTION

The present invention relates to a system for loading and unloading fluid products.

In connection with anchoring of vessels in such a situation, it is desired to arrive at a flexible solution so that any type of tanker (ship) can be used in the operation, independent of waves or sea depths.

SUMMARY OF THE INVENTION

The mentioned object may be reached with a loading and unloading system according to the present invention.

BRIEF DESCRIPTION OF THE DRAWINGS

The drawing shows on

DETAILED DESCRIPTION OF THE PREFERRED EMBODIMENTS

Figure 1:
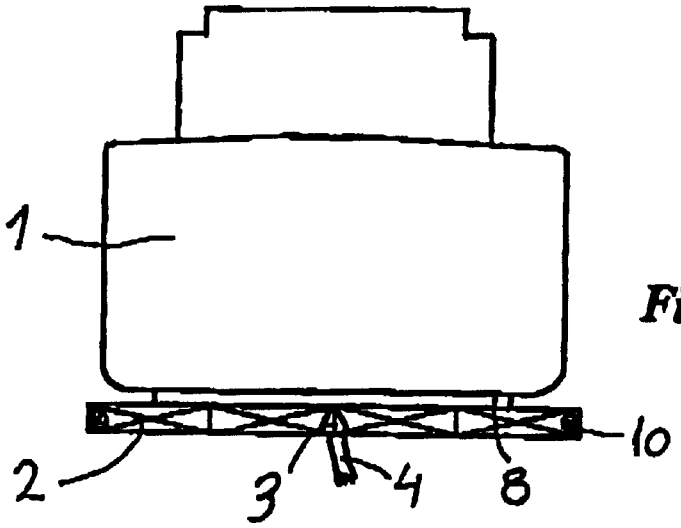
FIG. 1 a schematic front view of a ship with a frame according to the invention.

As shown on FIG. 1, the frame 2 is equipped with a coupling device 8 for coupling to the bottom of a ship 1. The coupling device 8 may be formed as suction cops, magnets or possibly cushion-like devices, which ensure contact of the frame 2 against the bottom of the ship by means of the buoyancy force of the frame 2.

The frame 2 has a turret-coupling 3 in which a liquid hose 4 may be coupled for supply of liquid, for example oil, from for example floating installations, permanent installations, submersible buoys, and loading towers etc. From the turret-coupling 3 runs a hose 9 to a coupling 7 on the ship for transport of liquid to or from the ship's tanks.

The frame 2 may conveniently be equipped with a propeller 10 for manoeuvring to placement under the ship 1. The frame 1 is held in position by means of a dynamic positioning system (DP-system), possibly with permanent anchoring.

Power supply for the frame 2 takes place from a control centre, which may be the production ship, a storage ship, a production platform, a shore station etc. The frame is steered to its position at the bottom of the ship 1. As the ship's bottom cannot be equipped with devices to receive a frame 2, the operation of fastening the frame to the ship 1 will be relatively uncomplicated, in that neither orienting in relation to the ship 1 or placement in the ship's I longitudinal direction will be critical. Steering and control of the frame is remotely controlled from the control centre.

Figure 2:
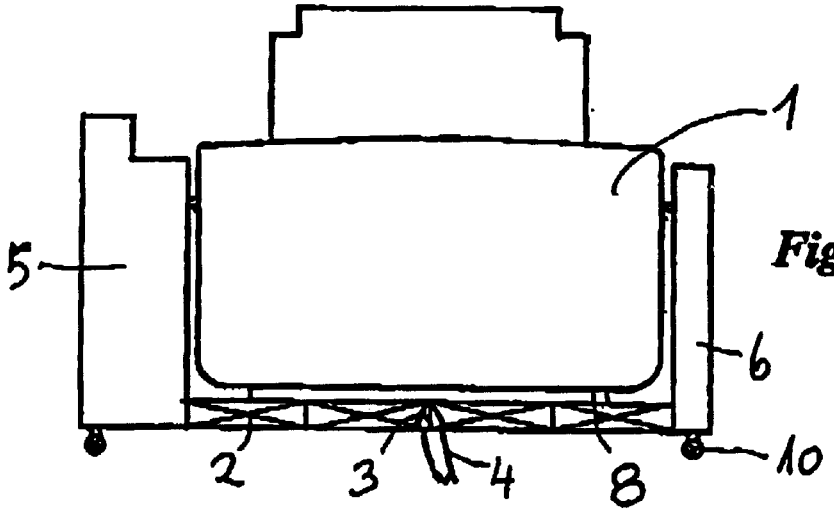
FIG. 2 shows a corresponding view of a ship with another embodiment of the invention and FIG. 3 shows a schematic side view of the frame attached hose ready for loading or unloading operations.
Figure 3:
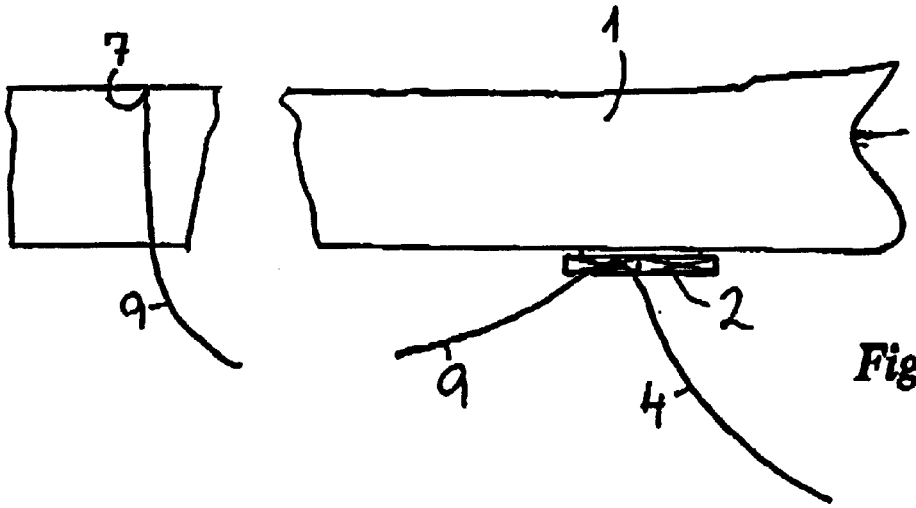

FIG. 2 shows another embodiment of the invention, where a short dock-like construction similarly has its own manoeuvring propellers 10 and where the power supply to the manoeuvring and the steering of the construction takes place from the dock-like construction 5 and 6. The construction 5 has preferably its own steering and control room, separate room for power supply units and separate rooms for ballast tanks and pumps. The two vertical walls of the construction 5 and 6 are at the bottom connected with a frame 2.

By means of the turret-coupling 3, the frame construction may rotate so that the tanker may turn by the wind and weather.

By means of the DP-system it is assured that the tanker is held in exact position during loading and unloading to another vessel or to the shore, for example in places lacking suitable docking facilities.

What is claimed is:

1. System for loading and unloading of fluid products to or from a vessel (1), comprising:

a fluid hose (4);

a submerged frame (2), said submerged frame (2) having a bottom side, said fluid hose (4) being fastened to said bottom side of said submerged frame (2), said submerged frame (2) being free to turn around a vertical axis with respect to said fluid hose (4) and being maneuverable with contact against the bottom of said vessel (1) and fixable in position during use; and an additional hose (9) connected to said fluid hose (4) at said submerged frame (2) for coupling to said vessel (1) for loading and unloading, wherein said submerged frame (2) has positioning equipment (10) for maneuvering and positioning.

2. System according to claim 1, wherein said positioning equipment (10) is adapted to position said submerged frame (2) relative to said vessel (1) and to let said submerged frame (2), together with said vessel (1), turn with wind and waves.

3. System according to claim 1, wherein said submerged frame (2) is anchored to the sea bottom.

4. System according to claim 1, wherein said fluid hose (4) is connected to said submerged frame (2) with a turret coupling (3).

5. System according to claim 1, further comprising first and second side walls (5, 6) provided on two sides of said submerged frame (2), said side walls (5, 6) having tanks for ballast, steering and control equipment and units for power supply.

6. System according to claim 1, wherein said submerged frame (2) has a top side, said top side of said submerged frame (2) having equipment for contact with the bottom of said vessel (1).

7. System according to claim 6, wherein said equipment for contact is selected from the group consisting of suction cups, magnets and cushions.

8. System for loading and unloading of fluid products to or from a vessel (1), comprising:

a fluid hose (4);

a submerged frame (2), said submerged frame (2) having a bottom side, said fluid hose (4) being fastened to said bottom side of said submerged frame (2), said submerged frame (2) being free to turn around a vertical axis with respect to said fluid hose (4) and being maneuverable with contact against the bottom of said vessel (1) and fixable in position during use;

an additional hose (9) connected to said fluid hose (4) at said submerged frame (2) for coupling to said vessel (1) for loading and unloading; and first and second side walls (5, 6) provided on two sides of said submerged frame (2), said side walls (5, 6) having tanks for ballast, steering and control equipment and units for power supply.

* * * * *